US011105531B2

(12) United States Patent
Stewart et al.

(10) Patent No.: US 11,105,531 B2
(45) Date of Patent: Aug. 31, 2021

(54) BLOWER ASSEMBLY

(71) Applicant: Trane International Inc., Davidson, NC (US)

(72) Inventors: Jeffrey L. Stewart, Whitehouse, TX (US); Mark Hudgins, Whitehouse, TX (US); Richard Lee Jameson, Tyler, TX (US); Kirk W. Beason, Tyler, TX (US)

(73) Assignee: Trane International Inc., Davidson, NC (US)

( * ) Notice: Subject to any disclaimer, the term of this patent is extended or adjusted under 35 U.S.C. 154(b) by 264 days.

(21) Appl. No.: 16/353,376

(22) Filed: Mar. 14, 2019

(65) Prior Publication Data

US 2019/0212031 A1 Jul. 11, 2019

Related U.S. Application Data

(63) Continuation of application No. 13/098,265, filed on Apr. 29, 2011, now abandoned.

(51) Int. Cl.
*F24F 13/20* (2006.01)
*F24F 1/0007* (2019.01)
(Continued)

(52) U.S. Cl.
CPC ..... *F24F 13/20* (2013.01); *F24F 1/0007* (2013.01); *F24F 1/0022* (2013.01); *F24F 1/0063* (2019.02); *F24F 1/0067* (2019.02); *F24F 13/222* (2013.01)

(58) Field of Classification Search
CPC ..... F24F 1/0007; F24F 13/22; F25D 21/14; F25D 2321/14; F25D 2321/144; F25D 2321/1441
(Continued)

(56) References Cited

U.S. PATENT DOCUMENTS 3,491,550 A * 1/1970 Cavis ..... F24F 13/22 62/285
3,524,328 A 8/1970 Schuster
(Continued)

FOREIGN PATENT DOCUMENTS

JP 0225677 A 1/1990

OTHER PUBLICATIONS

Office Action dated Jun. 20, 2014; U.S. Appl. No. 13/098,265, filed Apr. 29, 2011; 21 pages.
(Continued)

*Primary Examiner* — Steven B McAllister
*Assistant Examiner* — Ko-Wei Lin
(74) *Attorney, Agent, or Firm* — Womble Bond Dickinson, LLP

(57) ABSTRACT

An air handling unit has a blower assembly, a first interior zone, and a second interior zone and the blower assembly physically separates the first interior zone from the second interior zone. A method includes providing a cabinet configured to receive a blower assembly, inserting a blower assembly into the air duct, and closing a cabinet door of the cabinet, wherein upon closing the cabinet door, the primary air flow path from a location within the cabinet downstream of the blower assembly to a location within the cabinet upstream of the blower assembly is through a blower housing of the blower assembly. A blower assembly has a blower housing comprising at least one air inlet and at least one air outlet and a blower deck extending from the outlet, wherein the blower deck comprises at least one substantially flat component having a substantially orthogonal wall extending from the flat component.

19 Claims, 15 Drawing Sheets

(51) Int. Cl.

| | |
|---|---|
| *F24F 13/22* | (2006.01) |
| *F24F 1/0022* | (2019.01) |
| *F24F 1/0067* | (2019.01) |
| *F24F 1/0063* | (2019.01) |

(58) Field of Classification Search
USPC ..... 62/285–286, 291
See application file for complete search history.

(56) References Cited

U.S. PATENT DOCUMENTS

| | | | | |
|---|---|---|---|---|
| 3,775,029 | A | 11/1973 | Ranz | |
| 3,967,352 | A | 7/1976 | Crowe | |
| 4,127,162 | A | 11/1978 | Braver | |
| 4,266,602 | A | 5/1981 | White et al. | |
| 4,548,050 | A | 10/1985 | Drucker | |
| 4,986,087 | A | 1/1991 | Sullivan | |
| 5,042,269 | A * | 8/1991 | Sullivan | F04D 25/16 62/285 |
| 5,113,667 | A * | 5/1992 | Sullivan | F24F 1/0007 62/291 |
| 5,152,154 | A * | 10/1992 | Sullivan | F24F 1/0007 62/291 |
| 5,170,550 | A | 12/1992 | Cox et al. | |
| 5,195,332 | A * | 3/1993 | Sullivan | F24F 1/0007 62/291 |
| 6,295,823 | B1 * | 10/2001 | Odom | F24F 1/0007 62/176.6 |
| 6,863,496 | B2 | 3/2005 | Cho et al. | |
| 6,874,990 | B2 | 4/2005 | Nadeau | |
| 6,908,281 | B2 | 6/2005 | Lyons et al. | |
| 7,014,422 | B2 | 3/2006 | Hancock | |
| 7,108,478 | B2 | 9/2006 | Hancock | |
| 7,179,050 | B2 | 2/2007 | Hopfensperger | |
| 7,309,207 | B2 | 12/2007 | Horski et al. | |
| 7,591,633 | B2 | 9/2009 | Hancock | |
| 2004/0211553 | A1 * | 10/2004 | Hancock | F24F 11/81 165/260 |
| 2007/0059167 | A1 | 3/2007 | Hancock | |
| 2007/0129000 | A1 * | 6/2007 | Rasmussen | H05K 7/20736 454/184 |
| 2008/0245354 | A1 | 10/2008 | Hancock | |
| 2011/0016903 | A1 * | 1/2011 | Ballet | F24F 13/222 62/276 |
| 2012/0276836 | A1 | 11/2012 | Stewart et al. | |

OTHER PUBLICATIONS

Final Office Action dated Feb. 13, 2015; U.S. Appl. No. 13/098,265, filed Apr. 29, 2011; 15 pages.
Advisory Action dated Mar. 18, 2015; U.S. Appl. No. 13/098,265, filed Apr. 29, 2011; 7 pages.
Advisory Action dated Jun. 5, 2015; U.S. Appl. No. 13/098,265, filed Apr. 29, 2011; 4 pages.
Office Action dated Sep. 25, 2015; U.S. Appl. No. 13/098,265, filed Apr. 29, 2011; 14 pages.
Final Office Action dated Feb. 24, 2016; U.S. Appl. No. 13/098,265, filed Apr. 29, 2011; 16 pages.
Advisory Action dated Apr. 1, 2016; U.S. Appl. No. 13/098,265, filed Apr. 29, 2011; 3 pages.
Advisory Action dated Jun. 20, 2016; U.S. Appl. No. 13/098,265, filed Apr. 29, 2011; 4 pages.
Office Action dated Sep. 23, 2016; U.S. Appl. No. 13/098,265, filed Apr. 29, 2011; 12 pages.
Final Office Action dated Jan. 26, 2017; U.S. Appl. No. 13/098,265, filed Apr. 29, 2011; 10 pages.
Advisory Action dated Apr. 7, 2017; U.S. Appl. No. 13/098,265, filed Apr. 29, 2011; 4 pages.
Office Action dated Jun. 2, 2017; U.S. Appl. No. 13/098,265, filed Apr. 29, 2011; 12 pages.
Final Office Action dated Nov. 29, 2017; U.S. Appl. No. 13/098,265, filed Apr. 29, 2011; 17 pages.
Advisory Action dated Feb. 5, 2018; U.S. Appl. No. 13/098,265, filed Apr. 29, 2011; 4 pages.
Office Action dated Jun. 5, 2018; U.S. Appl. No. 13/098,265, filed Apr. 29, 2011; 24 pages.
Final Office Action dated Dec. 14, 2018; U.S. Appl. No. 13/098,265, filed Apr. 29, 2011; 13 pages.
Canadian Office Action; Application No. 2,773,569; dated Oct. 22, 2013; 2 pages.
Canadian Office Action; Application No. 2,773,569; dated Jul. 3, 2014; 2 pages.

* cited by examiner

BLOWER ASSEMBLY

CROSS-REFERENCE TO RELATED APPLICATIONS

This is a continuation application of the prior filed, co-pending U.S. patent application Ser. No. 13/098,265 filed on Apr. 29, 2011 by Jeffrey L. Stewart, et al., entitled "Blower Assembly," the disclosure of which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and air conditioning systems (HVAC systems) sometimes comprise air handling units comprising blower assemblies that attach to zone separation decks of the air handling units.

SUMMARY OF THE DISCLOSURE

In some embodiments, an air handling unit is provided that comprises a blower assembly, a first interior zone, and a second interior zone, wherein the blower assembly physically separates the first interior zone from the second interior zone.

In other embodiments, a method of creating air pressure zones in an air handling unit is provided that comprises providing a cabinet configured to receive a blower assembly, inserting a blower assembly into the air duct, and closing a cabinet door of the cabinet, wherein upon closing the cabinet door, the primary air flow path from a location within the cabinet downstream of the blower assembly to a location within the cabinet upstream of the blower assembly is through a blower housing of the blower assembly.

In yet other embodiments, a blower assembly for an air handling unit of an HVAC system is provided and the blower assembly comprises a blower housing comprising at least one air inlet and at least one air outlet and a blower deck extending from the outlet, wherein the blower deck comprises at least one substantially flat component having a substantially orthogonal wall extending from the flat component.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Figure 1:
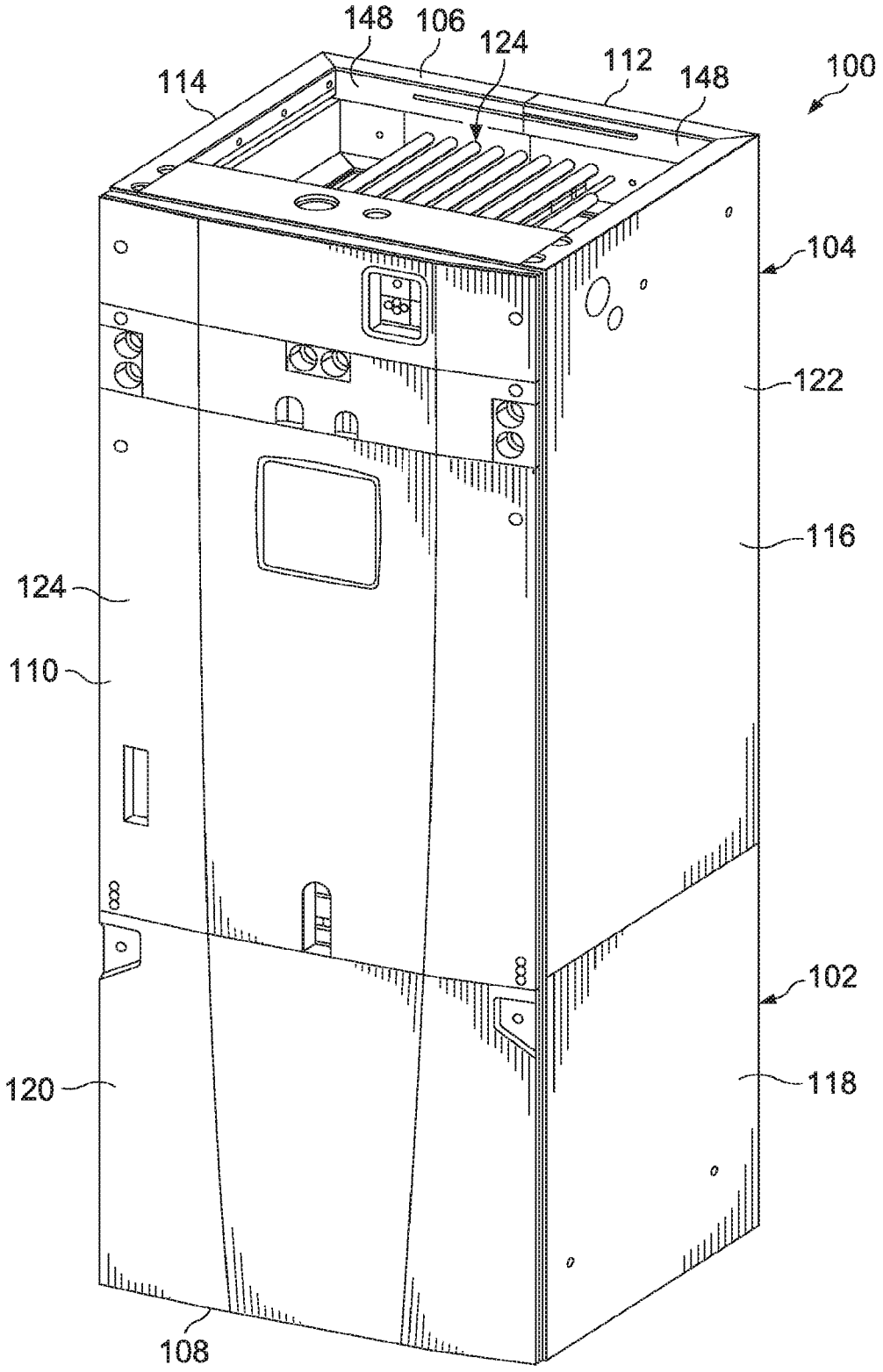
FIG. 1 is an oblique view of an air handling unit according to embodiments of the disclosure.

Interior walls of some air handling units may be planar in construction, covered with insulation that may release particulate matter, and may be configured to carry a plurality of brackets for carrying removable components of the air handling units. The removable components of such air handling units may need to be rearranged to configure the air handling unit for use in a particular installation configuration with respect to the direction of gravity. For example, a removable drain pan may need to be relocated within the air handling unit for use in a particular installation configuration. Still further, construction of the air handling units may be time consuming and/or difficult due to a need to install a variety of brackets and/or support structures to the interior walls of the air handling units. Further, removal and/or replacement of the removable components of some current air handling units may be unnecessarily difficult due to complicated multi-piece mounting brackets and supports.

Accordingly, the present disclosure provides, among other features, an air handling unit (AHU) that comprises interior cabinet walls shaped and/or otherwise configured to selectively carry removable components of the AHU with a reduced need for brackets and supports. The interior cabinet walls of the AHU of the present disclosure may be further shaped and/or otherwise configured to reduce or eliminate the need to rearrange components within the AHU to configure the AHU for a selected installation orientation relative to the direction of gravity. In some embodiments, an AHU of the disclosure may comprise interior cabinet walls that are formed and/or shaped to integrally comprise brackets and/or other mounting features for carrying removable components. In some embodiments, an AHU may comprise integral drain pans, the integral drain pans being suitable for use in different installation orientations with respect to the direction of gravity.

AHUs of some HVAC systems comprise blower assemblies that attach to zone separation decks installed in the blower cabinet portion of the AHUs. In some cases, the zone separation decks are structurally inadequate to prevent significant amounts of vibration, stress cracks, and/or other mechanical failures due to the deck carrying heavy blower assemblies. In some cases, the zone separation decks may be formed as a substantially planar component having a hole shaped and/or sized to accommodate connection to an output of the blower assembly. In some cases, the hole in the planar component is located well within the entrance to the blower assemblies so that installation and removal of a blower assembly requires reaching far into the blower cabinet while simultaneously attempting to align features of the blower assembly with complementary features of the deck.

Accordingly, the present disclosure, in some embodiments, provides systems and methods for providing and/or installing blower assemblies without the need to carefully manage the position of a heavy blower assembly while installing it into an AHU. In some embodiments, the present disclosure provides a blower assembly comprising an integral blower deck. In some embodiments, the integral blower deck may easily be received into an AHU by sliding edges of the integral blower deck into mounting channels of the AHU. In some embodiments, the mounting channels of the AHU may be located along the interior walls of the AHU. In some embodiments, the mounting channels may be integral with the interior walls of the AHU.

Figure 2:
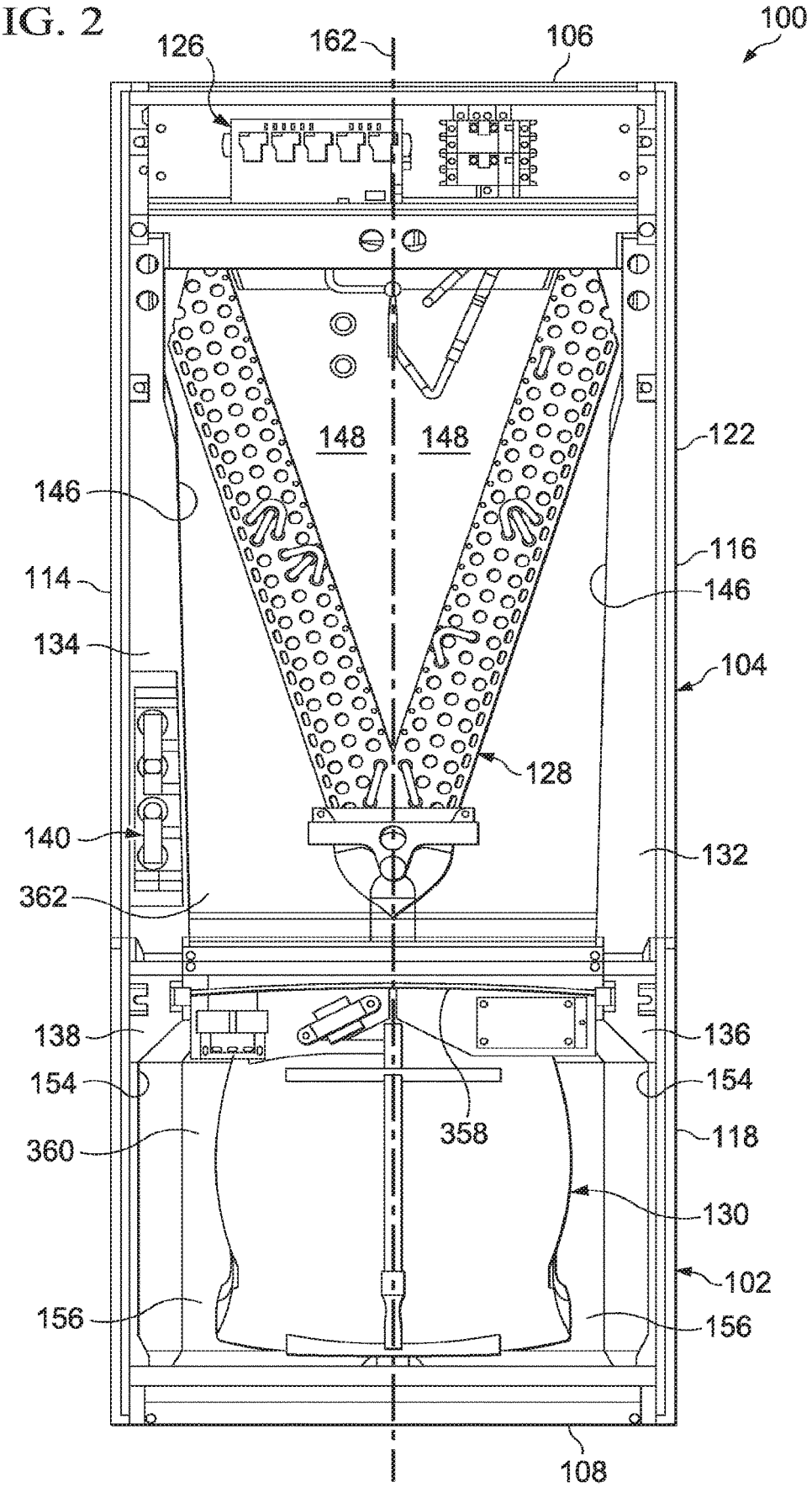
FIG. 2 is an orthogonal view of the front of the air handling unit of FIG. 1.
Figure 3:
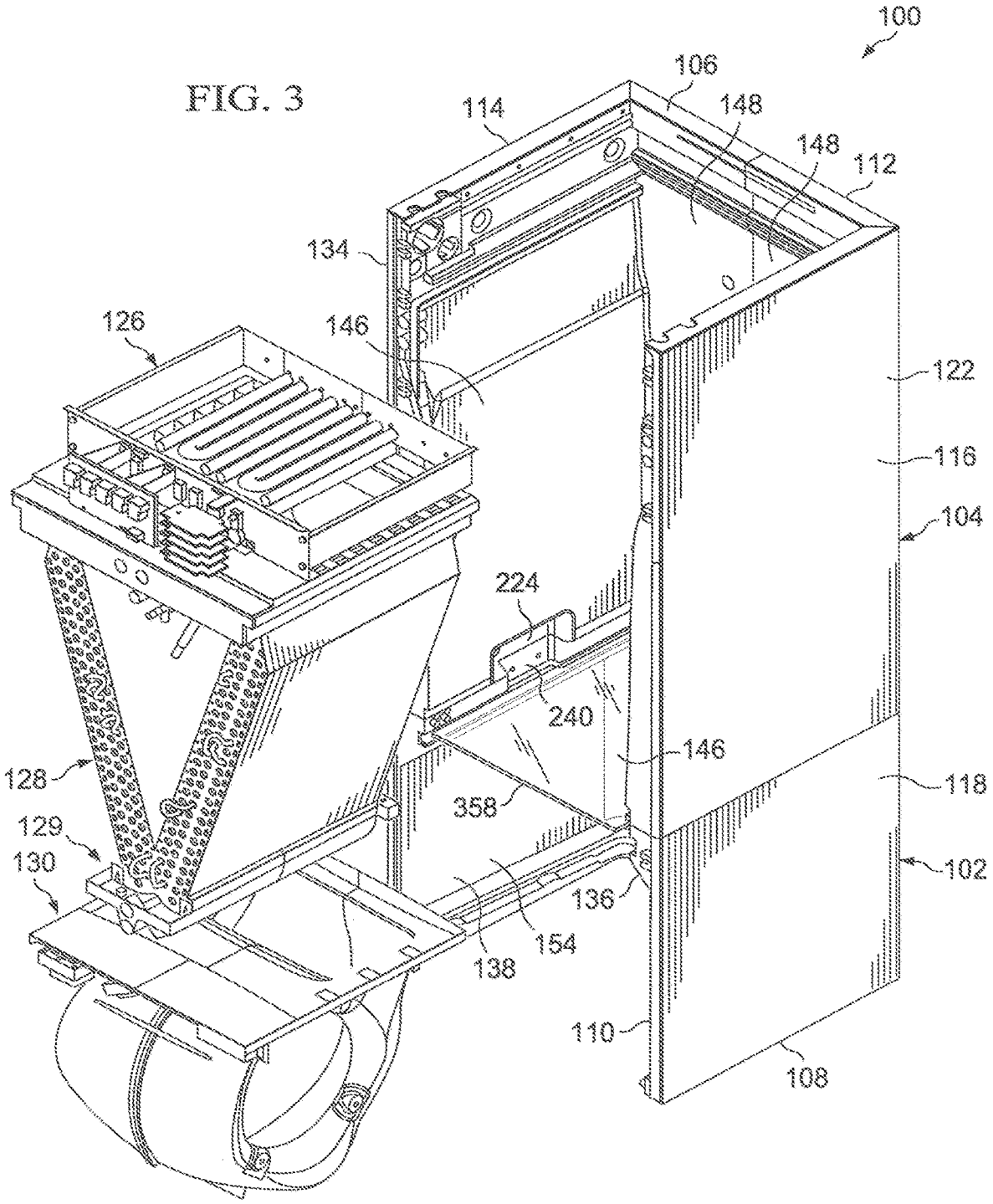
FIG. 3 is a partially exploded oblique view of the air handling unit of FIG. 1.

Referring now to FIGS. 1-3, an AHU 100 according to the disclosure is shown. In this embodiment, AHU 100 comprises a lower blower cabinet 102 attached to an upper heat exchanger cabinet 104. Most generally and for purposes of this discussion, AHU 100 may be described as comprising a top side 106, a bottom side 108, a front side 110, a back side 112, a left side 114, and a right side 116. Such directional descriptions are meant to assist the reader in understanding the physical orientation of the various components parts of the AHU 100 but that such directional descriptions shall not be interpreted as limitations to the possible installation orientations of an AHU 100. Further, the above-listed directional descriptions may be shown and/or labeled in the figures by attachment to various component parts of the AHU 100. Attachment of directional descriptions at different locations or two different components of AHU 100 shall not be interpreted as indicating absolute locations of directional limits of the AHU 100, but rather, that a plurality of shown and/or labeled directional descriptions in a single Figure shall provide general directional orientation to the reader so that directionality may be easily followed amongst various Figures. Still further, the component parts and/or assemblies of the AHU 100 may be described below as generally having top, bottom, front, back, left, and right sides which should be understood as being consistent in orientation with the top side 106, bottom side 108, front side 110, back side 112, left side 114, and right side 116 of the AHU 100.

Blower cabinet 102 comprises a four-walled fluid duct that accepts fluid (air) in through an open bottom side of the blower cabinet 102 and allows exit of fluid through an open top side of the blower cabinet 102. In this embodiment, the exterior of the blower cabinet 102 comprises a blower cabinet outer skin 118 and a blower cabinet panel 120. The blower cabinet panel 120 is removable from the remainder of the blower cabinet 102 thereby allowing access to an interior of the blower cabinet 102. Similarly, heat exchanger cabinet 104 comprises a four-walled fluid duct that accepts fluid (air) from the blower cabinet 102 and passes the fluid from an open bottom side of the heat exchanger cabinet 104 and allows exit of the fluid through an open top side of the heat exchanger cabinet 104. In this embodiment, the exterior of the heat exchanger cabinet 104 comprises a heat exchanger cabinet outer skin 122 and a heat exchanger cabinet panel 124. The heat exchanger cabinet panel 124 is removable from the remainder of the heat exchanger cabinet 104 thereby allowing access to an interior of the heat exchanger cabinet 104.

The AHU 100 further comprises a plurality of selectively removable components. More specifically, the AHU 100 comprises a heater assembly 126 and may be removably carried within the heat exchanger cabinet 104. The AHU 100 further comprises a refrigeration coil assembly 128 that may also be removably carried within the heat exchanger cabinet 104. In this embodiment, the heater assembly 126 is configured to be optionally carried within heat exchanger cabinet 104 nearer the top side 106 of the AHU 100 than the refrigeration coil assembly 128. Similarly, the AHU 100 comprises a blower assembly 130 that may be removably carried within the blower cabinet 102. The AHU 100 may be considered fully assembled when the blower assembly 130 is carried within the blower cabinet 102, each of the refrigeration coil assembly 128 and the heater assembly 126 are carried within the heat exchanger cabinet 104, and when the blower cabinet panel 120 and heat exchanger cabinet panel 124 are suitably associated with the blower cabinet outer skin 118 and the heat exchanger cabinet outer skin 122, respectively. When the AHU 100 is fully assembled, fluid (air) may generally follow a path through the AHU 100 along which the fluid enters through the bottom side 108 of the AHU 100, successively encounters the blower assembly 130, the refrigeration coil assembly 128, and the heater assembly 126, and thereafter exits the AHU 100 through the top side 106 of the AHU 100.

In this embodiment, each of the four walls of the blower cabinet 102 and the heat exchanger cabinet 104 are configured to have a double-wall construction. More specifically, the heat exchanger cabinet 104 further comprises a heat exchanger cabinet right shell 132 and a heat exchanger cabinet left shell 134. In this embodiment, the heat exchanger cabinet right shell 132 and the heat exchanger cabinet left shell 134 may be joined to generally form the interior of the heat exchanger cabinet 104. In order to form the above-mentioned double-wall construction for the heat exchanger cabinet 104, the heat exchanger cabinet outer skin 122 generally covers the right side and back side of the heat exchanger cabinet right shell 132 while also generally covering the left side and back side of the heat exchanger cabinet left shell 134. Most generally, the heat exchanger cabinet right shell 132, the heat exchanger cabinet left shell 134, and the heat exchanger cabinet outer skin 122 are shaped so that upon their assembly together a heat exchanger cabinet wall space exists between the heat exchanger cabinet outer skin 122 and each of the heat exchanger cabinet right shell 132 and the heat exchanger cabinet left shell 134. The blower cabinet right shell 136, the blower cabinet left shell 138, and the blower cabinet outer skin 118 are also shaped so that upon their assembly together a blower cabinet wall space exists between the blower cabinet outer skin 118 and each of the blower cabinet right shell 136 and the blower cabinet left shell 138.

In some embodiments, one or more of the heat exchanger cabinet wall space and blower cabinet wall space may be at least partially filled with an insulating material. More specifically, in some embodiments, a polyurethane foam may at least partially fill exchanger cabinet wall space and the lower cabinet wall space. At least partially filling one or more of the spaces may increase a structural integrity of the AHU 100, may increase a thermal resistance of the AHU 100 between the interior of the AHU 100 and the exterior of the AHU 100, may decrease air leakage from the AHU 100, and may reduce and/or eliminate the introduction of volatile organic compounds (VOCs) into breathing air attributable to the AHU 100. Such a reduction in VOC emission by the AHU 100 may be attributable to the lack of and/or reduced use of traditional fiberglass insulation within the AHU 100 made possible by the insulative properties provided by the polyurethane foam within the spaces.

In some embodiments, each of the blower cabinet outer skin 118 and the heat exchanger cabinet outer skin 122 may be constructed of metal and/or plastic. Each of the heat exchanger cabinet right shell 132, the heat exchanger cabinet left shell 134, blower cabinet right shell 136, and blower cabinet left shell 138 may be constructed of a sheet molding compound (SMC). The SMC may be chosen for its ability to meet the primary requirements of equipment and/or safety certification organizations and/or its relatively rigid cleanable surfaces that are resistant to mold growth and compatible with the use of antimicrobial cleaners. Further, the polyurethane foam used to fill the spaces may comprise refrigerant and/or pentane to enhance the thermal insulating characteristics of the foam. Of course, in alternative embodiments, any other suitable material may be used to form the components of the AHU 100.

Further, each of the heat exchanger cabinet right shell 132 and the heat exchanger cabinet left shell 134 comprise an interior side surface 146, an interior rear surface 148, an exterior side surface, and an exterior rear surface. Similarly, each of the blower cabinet right shell 136 and the blower cabinet left shell 138 comprise an interior side surface 154, an interior rear surface 156, an exterior side surface, and an exterior rear surface. Most generally, and with a few exceptions, each of the pairs of interior side surfaces 146, interior rear surfaces 148, exterior side surfaces, exterior rear surfaces, interior side surfaces 154, interior rear surfaces 156, exterior side surfaces, and exterior rear surfaces are substantially mirror images of each other. More specifically, the above listed pairs of surfaces are substantially mirror images of each other about a bisection plane 162 (see FIG. 2) that is generally parallel to both the AHU left side 114 and the AHU right side 116 and which is substantially equidistant from both the AHU left side 114 and the AHU right side 116.

Figure 4:
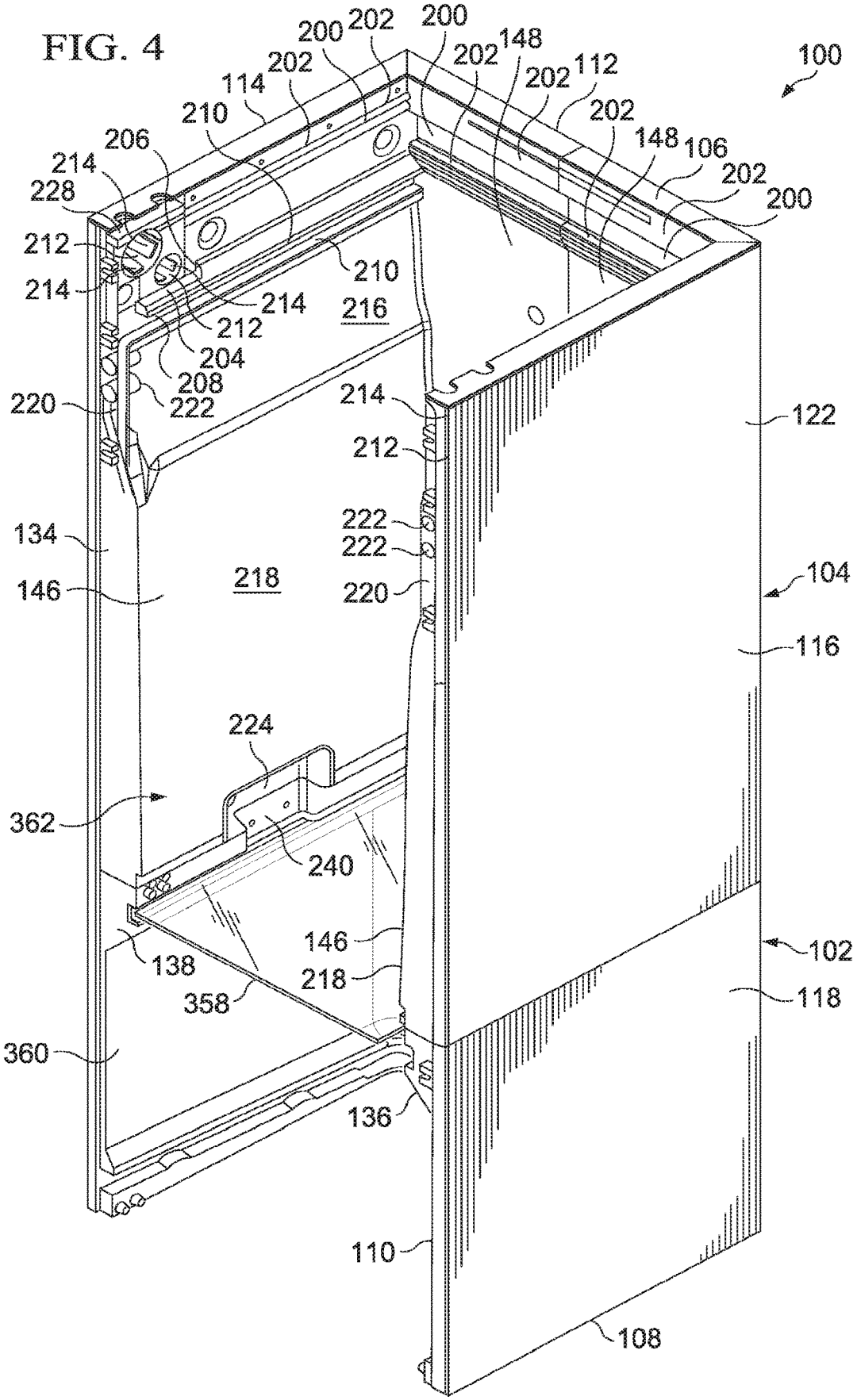
FIG. 4 is a simplified oblique view of the air handling unit of FIG. 1 showing a plurality of inner shell components encased within outer skins.
Figure 5:
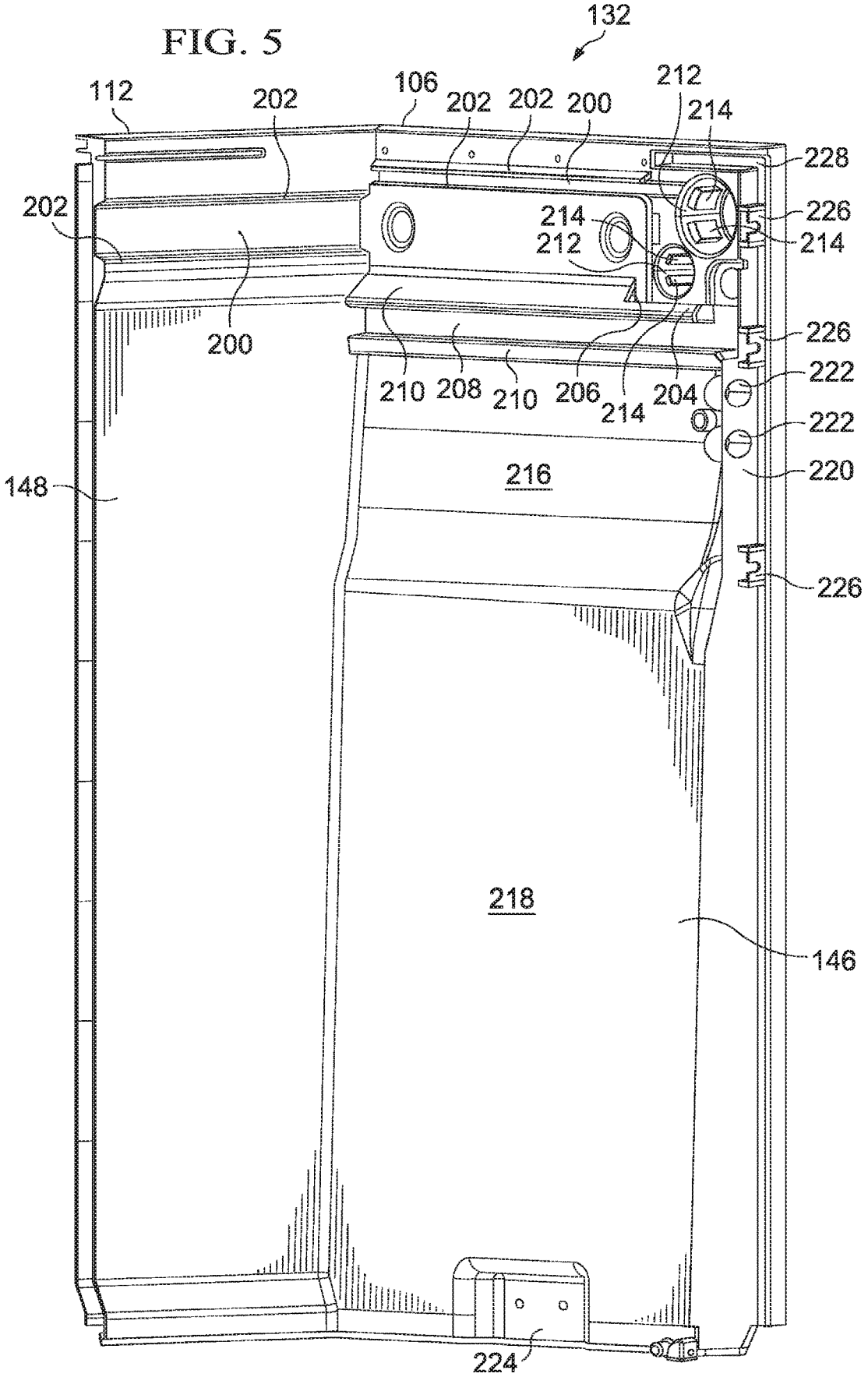
FIG. 5 is an oblique left side view of the heat exchanger cabinet right shell of FIG. 1.

Referring now to FIGS. 4 and 5, simplified views of the AHU 100 are provided. Each of the heat exchanger cabinet right shell 132, the heat exchanger cabinet left shell 134, the blower cabinet right shell 136, and the blower cabinet left shell 138 comprise integral features for carrying removable components of the AHU 100. More specifically, the interior side surfaces 146 and interior rear surfaces 148 of the heat exchanger cabinet right shell 132 and the heat exchanger cabinet left shell 134 comprise heater assembly mounting channels 200 bound above and below by heater assembly rails 202. The heater assembly rails 202 protrude inwardly from the remainder of the respective interior side surfaces 146 and interior rear surfaces 148 so that complementary shaped structures of the heater assembly 126 may be received within the channels 200 and retained within the channels 200 by the heater assembly rails 202. In this embodiment, the heater assembly 126 may be selectively inserted into the heat exchanger cabinet 104 by aligning the heater assembly 126 properly with the heater assembly mounting channels 200 and sliding the heater assembly 126 toward the AHU back side 112. Of course, the heater assembly 126 may be selectively removed from the heat exchanger cabinet 104 by sliding the heater assembly 126 away from the AHU back side 112. Further, one or more of the interior side surfaces 146 may comprise a heater assembly shelf 204 to slidingly receive a portion of the heater assembly 126 during insertion of the heater assembly 126 until the heater assembly 126 abuts a shelf back wall 206.

Still referring to FIGS. 4 and 5, the interior side surfaces 146 of the heat exchanger cabinet right shell 132 and the heat exchanger cabinet left shell 134 comprise refrigeration coil assembly mounting channels 208 bound above and below by refrigeration coil assembly rails 210. The refrigeration coil assembly rails 210 protrude inwardly from the remainder of the respective interior side surfaces 146 so that complementary shaped structures of the refrigeration coil assembly 128 may be received within the channels 208 and retained within the channels 208 by the refrigeration coil assembly rails 210. In this embodiment, the refrigeration coil assembly 128 may be selectively inserted into the heat exchanger cabinet 104 by aligning the refrigeration coil assembly 128 properly with the refrigeration coil assembly mounting channels 208 and sliding the refrigeration coil assembly 128 toward the AHU back side 112. Of course, the refrigeration coil assembly 128 may be selectively removed from the heat exchanger cabinet 104 by sliding the refrigeration coil assembly 128 away from the AHU back side 112. Drain 129 may be positioned below the refrigeration coil assembly 128 to collect condensation from the refrigeration coil assembly 128.

It will further be appreciated that one or more of the heat exchanger cabinet right shell 132 and the heat exchanger cabinet left shell 134 may comprise integrally formed electrical conduit apertures 212 which form openings between the interior of the heat exchanger cabinet 104 and the heat exchanger cabinet wall space. The electrical conduit apertures 212 are formed and/or shaped to closely conform to the shape of electrical lines and/or electrical conduit that may be passed through the electrical conduit apertures 212. However, in some embodiments, stabilizer pads 214 may be integrally formed about the circumference of the electrical conduit apertures 212 so that the electrical lines and/or electrical conduit may be more tightly held, isolated from the general cylindrical surface of the electrical conduit apertures 212, and/or to reduce friction of insertion of electrical lines and/or electrical conduit while retaining a tight fit between the stabilizer pads 214 and the electrical lines and/or electrical conduit. Further, the stabilizer pads 214 may be configured to interact with nuts of electrical conduit connectors so that the stabilizer pads 214 serve to restrict rotational movement of such nuts. By restricting such rotational movement of nuts, the stabilizer pads 214 may provide easier assembly and/or disassembly of the electrical conduit and related connectors to the heat exchanger cabinet 104. The electrical conduit apertures 212 are not simply holes formed in the interior side surfaces 146, but rather, are substantially tubular protrusions extending outward from the exterior side surfaces.

It will further be appreciated that one or more of the heat exchanger cabinet right shell 132 and the heat exchanger cabinet left shell 134 may comprise drain pan indentions 216. More specifically, the heat exchanger interior side surfaces 146 may generally comprise a sloped portion 218 sloped from a bottom side to the drain pan indentions 216 so that the bottom of the interior side surfaces 146 protrude further inward and the remainder of the sloped portion 218. The drain pan indentions 216 may form a concavity open toward the interior of the heat exchanger cabinet 104. The interior side surfaces 146 further comprises a front boundary wall 220 with integral drain tubes 222 extending into the concavity formed by the drain pan indentions 216. In some embodiments, the AHU 100 may be installed and/or operated in an installation orientation where the drain pan indention 216 of an interior side surface 146 is located below the refrigeration coil assembly 128 and so that fluids may, with the assistance of gravity, aggregate within the concavity of the drain pan indention 216 and thereafter exit the AHU 100 through the integral drain tubes 222. More specifically, the sloped portion 218 may direct fluids falling from the refrigeration coil assembly 128 toward the concavity formed by a drain pan indention 216. In this manner, the integrally formed slope portion 218, the drain pan indentions 216, and the front boundary wall 220 may serve as a condensation drain pan for the AHU 100 and may prevent the need to install a separate drain pan and/or to rearrange the configuration of a separate drain pan based on a chosen installation orientation for the AHU 100. Further, when in use, a drain pan indention 216 and sloped portion 218 may cooperate with airflow generated by blower assembly 130 to direct condensation to the integral drain tubes 222.

It will further be appreciated that one or more of the heat exchanger cabinet right shell 132 and the heat exchanger cabinet left shell 134 may comprise integral assembly recesses 224. Assembly recesses 224 may be located near a lower end of the heat exchanger cabinet right shell 132 and the heat exchanger cabinet left shell 134. Assembly recesses 224 may accept mounting hardware therein for joining the heat exchanger cabinet 104 to the blower cabinet 102. In this embodiment, the recesses 224 are substantially shaped as box shaped recesses, however, in alternative embodiments, the recesses 224 may be shaped any other suitable manner. Additionally, one or more of the heat exchanger cabinet right shell 132 and the heat exchanger cabinet left shell 134 may comprise integral fastener retainer protrusions 226. Fastener retainer protrusions 226 may be used to hold threaded nuts or other fasteners. Further, in other embodiments, retainer protrusions 226 may themselves be threaded or otherwise configured to selectively retaining fasteners inserted therein. Still further, the heat exchanger cabinet right shell 132 and the heat exchanger cabinet left shell 134 may comprise support bar slots 228 configured to receive the opposing ends of a selectively removable structural crossbar.

Figure 6:
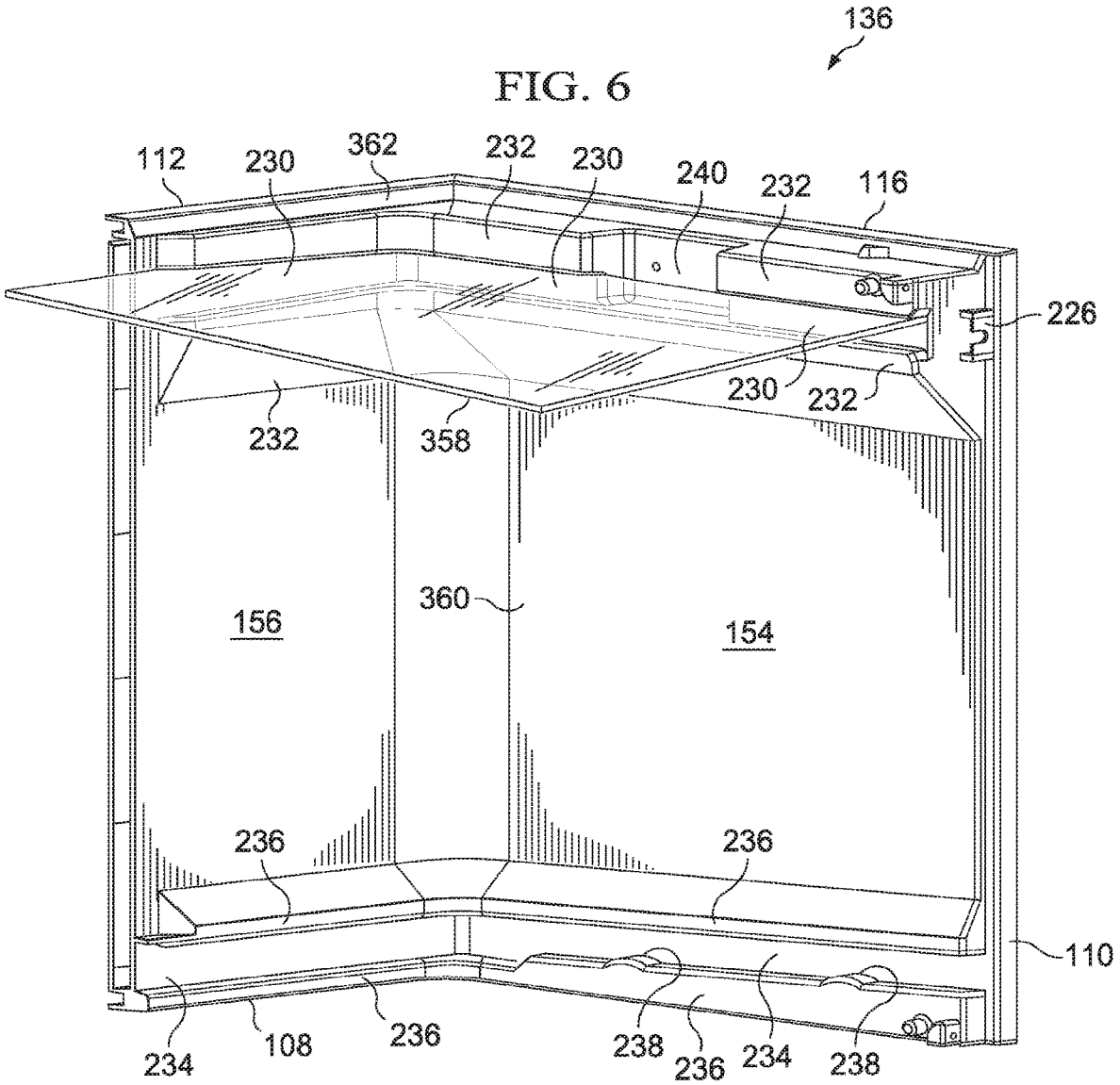
FIG. 6 is an oblique left side view of the blower cabinet right shell of FIG. 1.

Referring now to FIGS. 4 and 6, one or more of the blower cabinet right shell 136 and the blower cabinet left shell 138 may comprise blower assembly mounting channels 230 bound above and below by blower assembly rails 232. The blower assembly rails 232 protrude inwardly from the remainder of the respective interior side surfaces 154 so that complementary shaped structures of the blower assembly 130 may be received within the channels 230 and retained within the channels 230 by the blower assembly rails 232. In this embodiment, the blower assembly 130 may be selectively inserted into the blower cabinet 102 by aligning the blower assembly 130 properly with the blower assembly mounting channels 230 and sliding the blower assembly 130 toward the AHU back side 112. Of course, the blower assembly 130 may be selectively removed from the blower cabinet 102 by sliding the blower assembly 130 away from the AHU back side 112.

It will further be appreciated that one or more of the blower cabinet right shell 136 and the blower cabinet left shell 138 may comprise filter mounting channels 234 bound above and below by filter rails 236. The filter rails 236 protrude inwardly from the remainder of the respective interior side surfaces 154 so that complementary shaped structures of a filter may be received within the channels 234 and retained within the channels 234 by the filter rails 236. In this embodiment, a filter may be selectively inserted into the blower cabinet 102 by aligning the filter properly with the filter mounting channels 234 and sliding the filter toward the AHU back side 112. Of course, the filter may be selectively removed from the blower cabinet 102 by sliding the filter away from the AHU back side 112. In some embodiments, the filter mounting channel 234 may be sloped downward from the front to the back of the AHU 100. Further, in some embodiments, one or more of the filter rails 236 may comprise filter protrusions 238 which may serve to more tightly hold a filter inserted into the filter mounting channels 234. In some embodiments, one or more of the blower cabinet right shell 136 and the blower cabinet left shell 138 may comprise fastener retainer protrusions 226. Still further, one or more of the blower cabinet right shell 136 and the blower cabinet left shell 138 may comprise integral assembly recesses 240. Assembly recesses 240 may be located near an upper end of the blower cabinet right shell 136 and the blower cabinet left shell 138. Assembly recesses 240 may accept mounting hardware therein for joining the blower cabinet 102 to the heat exchanger cabinet 104. In this embodiment, the recesses 240 are substantially shaped as box shaped recesses, however, in alternative embodiments, the recesses 240 may be shaped in any other suitable manner.

While many of the features of the heat exchanger cabinet right shell 132, heat exchanger cabinet left shell 134, blower cabinet right shell 136, and blower cabinet left shell 138 may be formed integrally to those respective components in a single molding and/or injection process. However in alternative embodiments, the various integral features may be provided through a series of moldings, and/or injections, thermal welding, gluing, or any other suitable means of assembling a singular structure comprising the various features as is well known to those skilled in the art. Further, one or more of the components disclosed herein as being formed integrally, in some embodiments, may be formed from multiple components coupled together.

Figure 7:
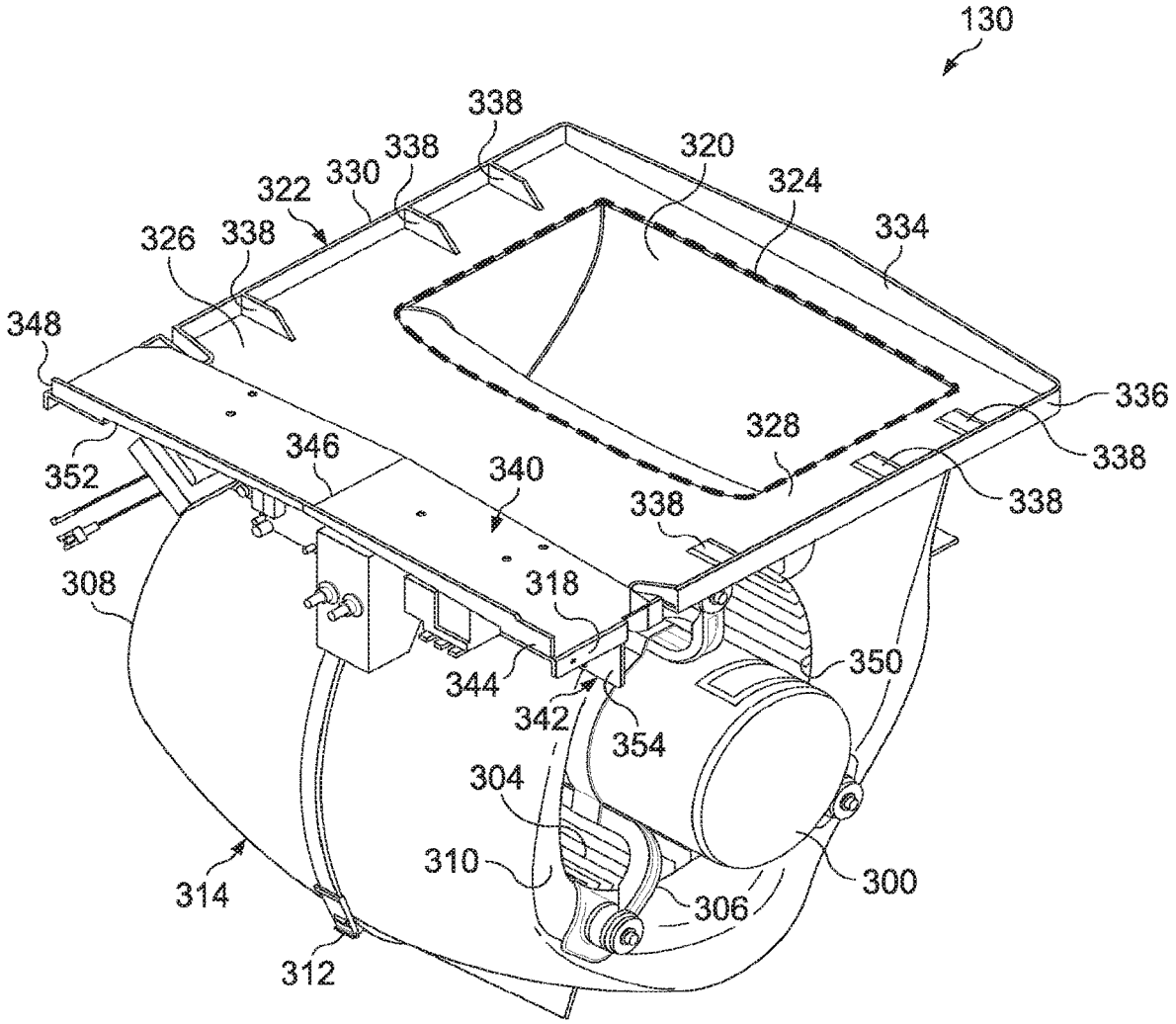
FIG. 7 is an oblique view of a blower assembly of FIG. 2 from a front-upper-right viewpoint.
Figure 8:
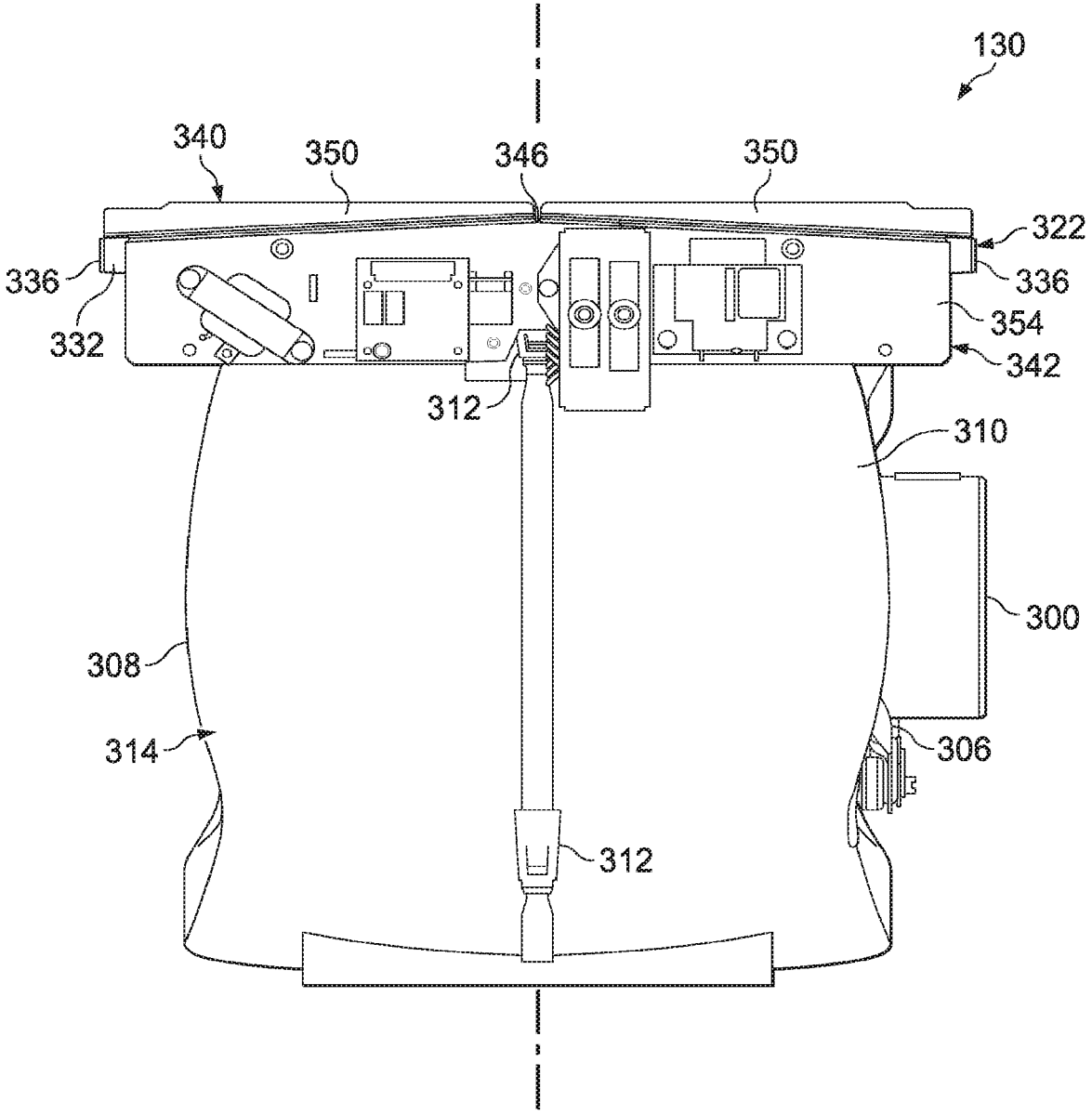
FIG. 8 is an orthogonal front view of the blower assembly of FIG. 2.
Figure 9:
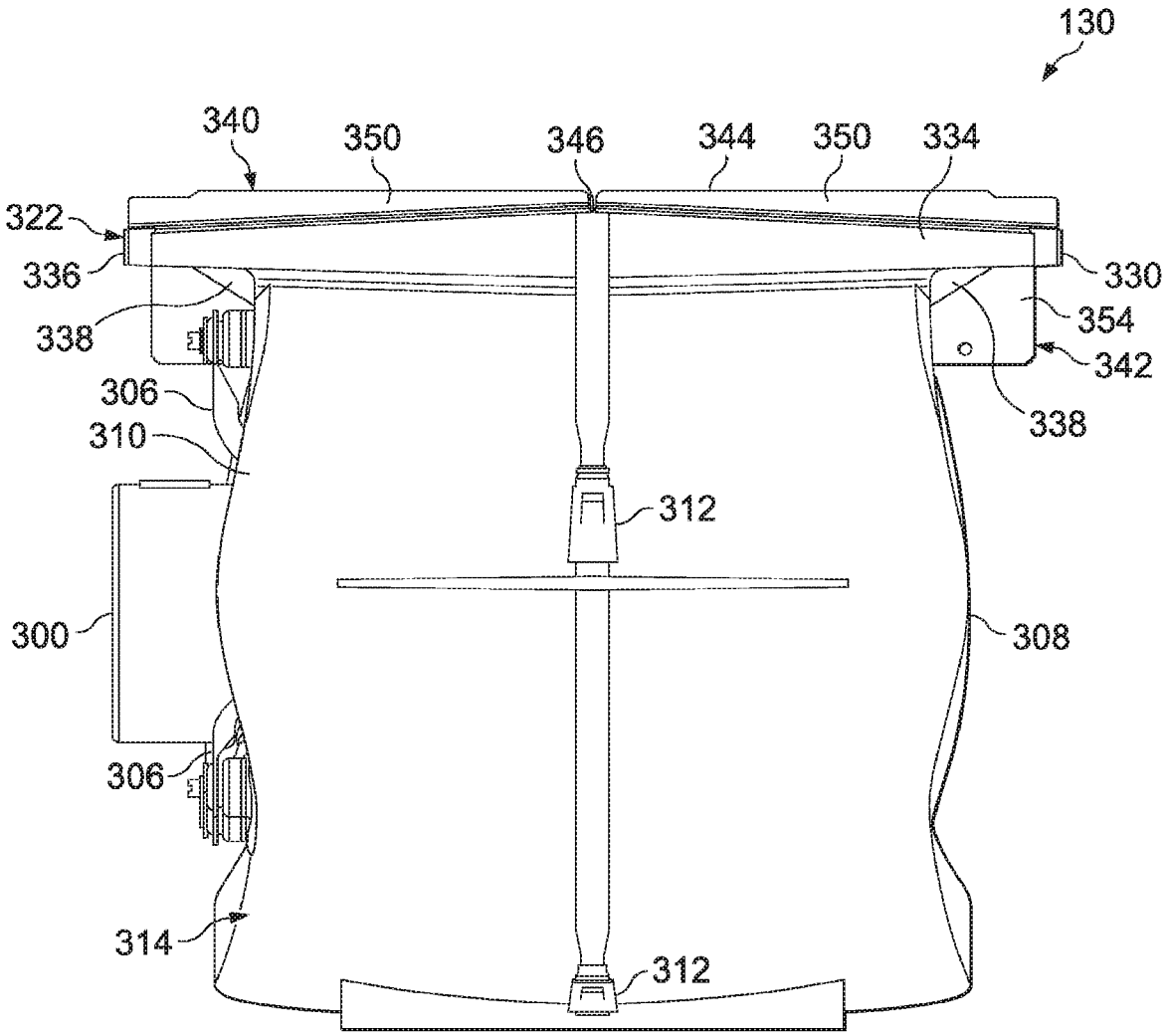
FIG. 9 is an orthogonal rear view of the blower assembly of FIG. 2.
Figure 10:
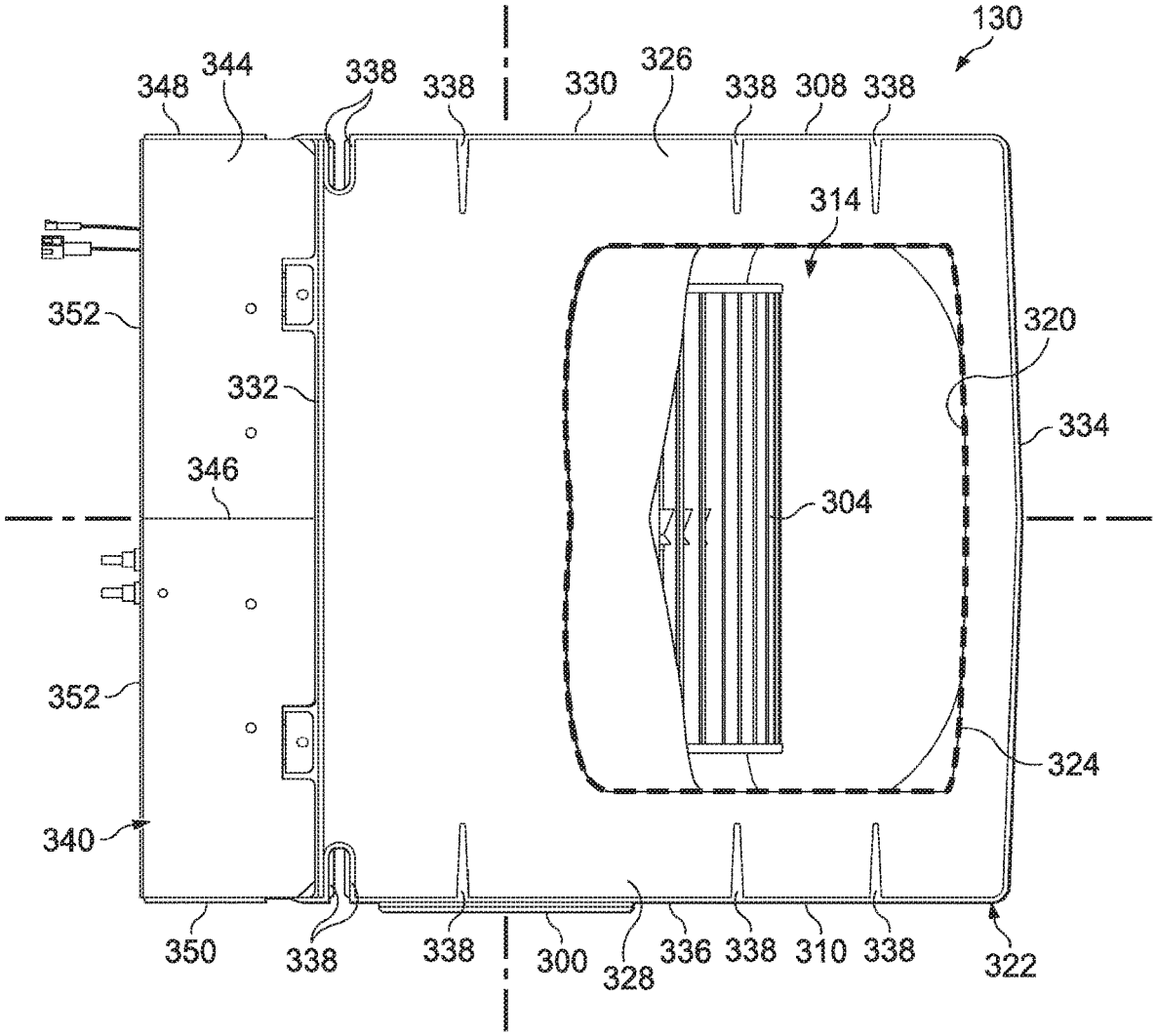
FIG. 10 is an orthogonal top view of the blower assembly of FIG. 2.
Figure 11:
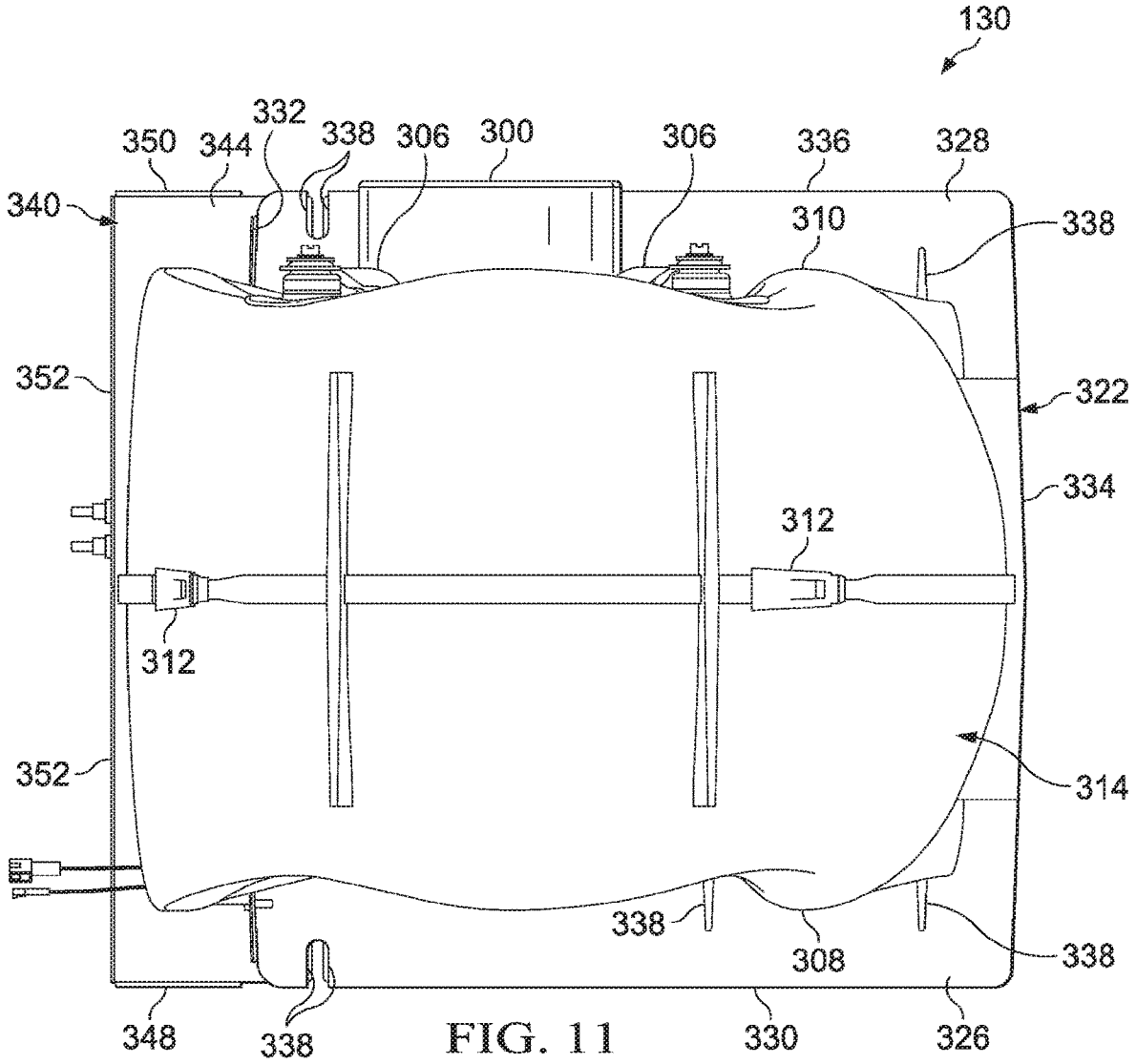
FIG. 11 is an orthogonal bottom view of the blower assembly of FIG. 2.
Figure 12:
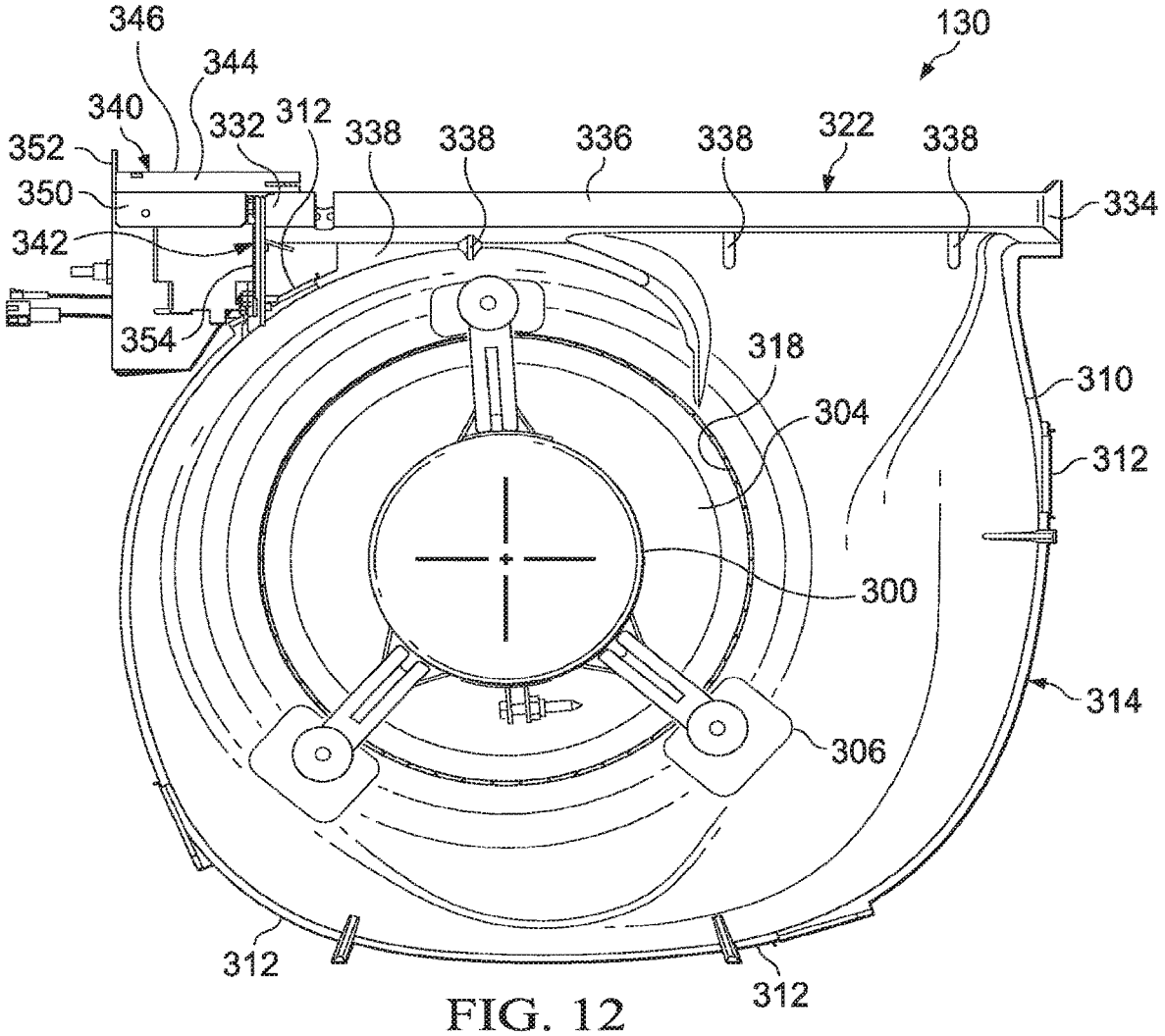
FIG. 12 is an orthogonal right side view of the blower assembly of FIG. 2.
Figure 13:
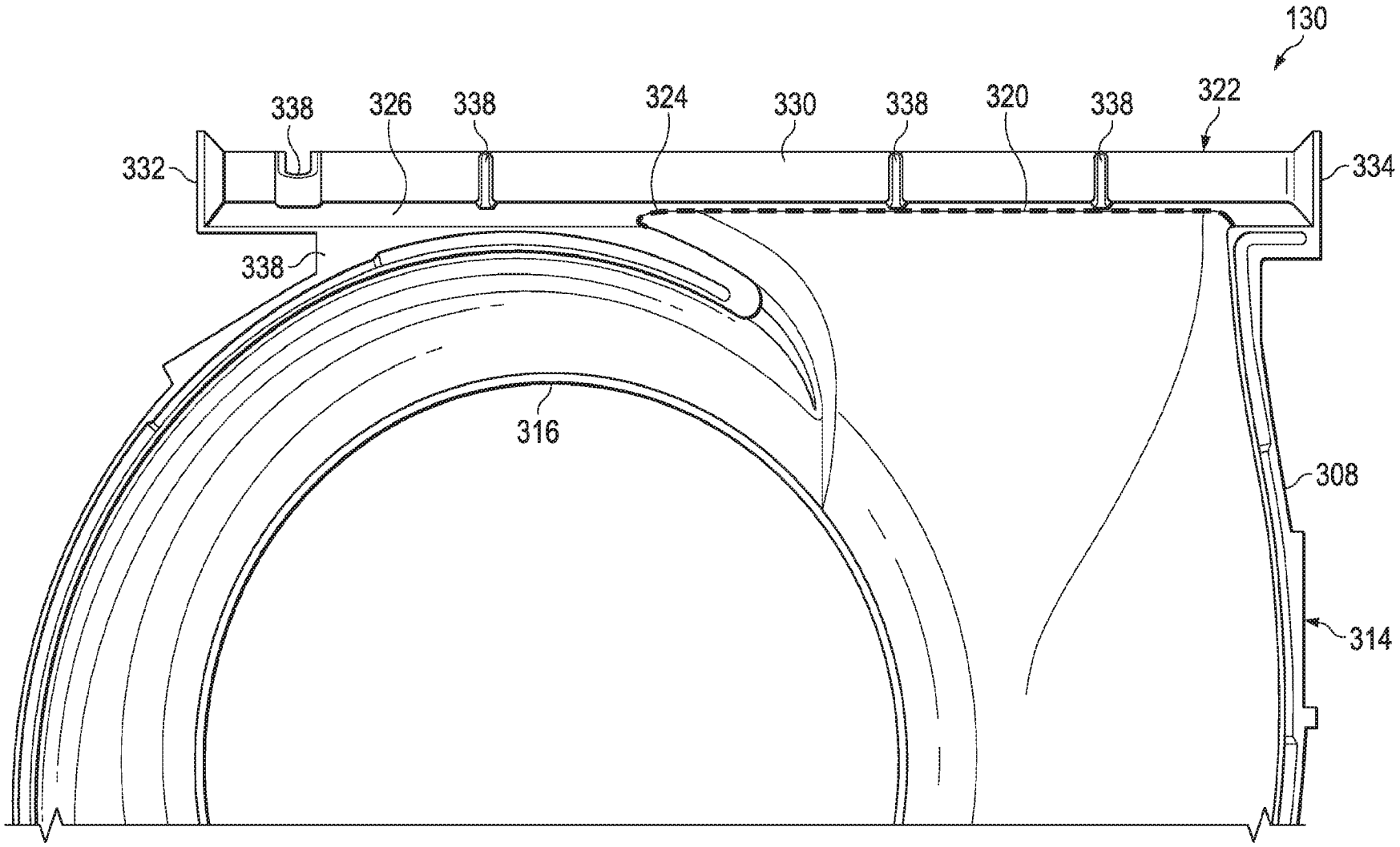
FIG. 13 is a partial cross-sectional orthogonal right side view of the blower assembly of FIG. 2.
Figure 14:
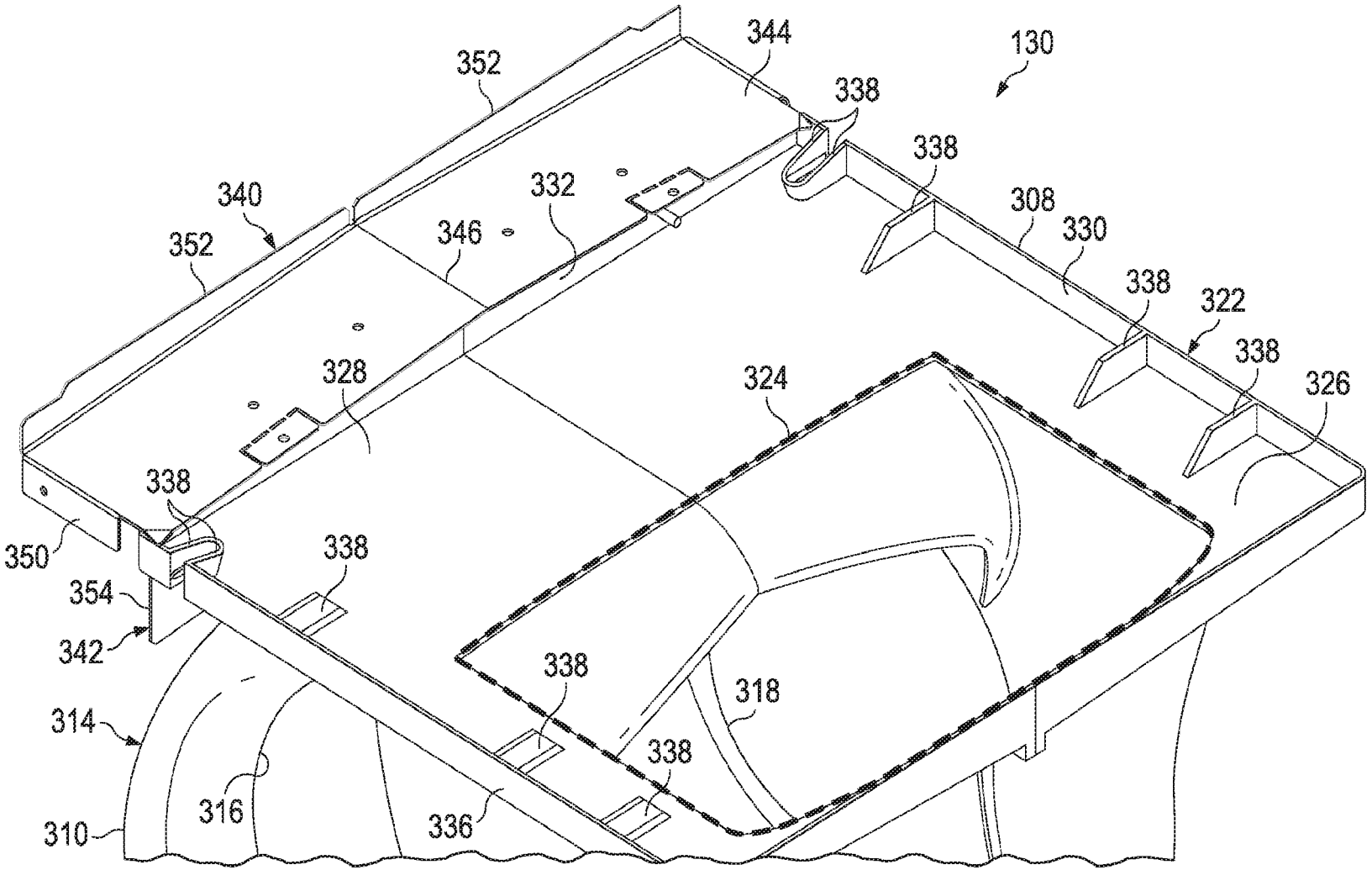
FIG. 14 is an oblique partial view of the blower assembly of FIG. 2 from a rear-upper-right viewpoint.
Figure 15:
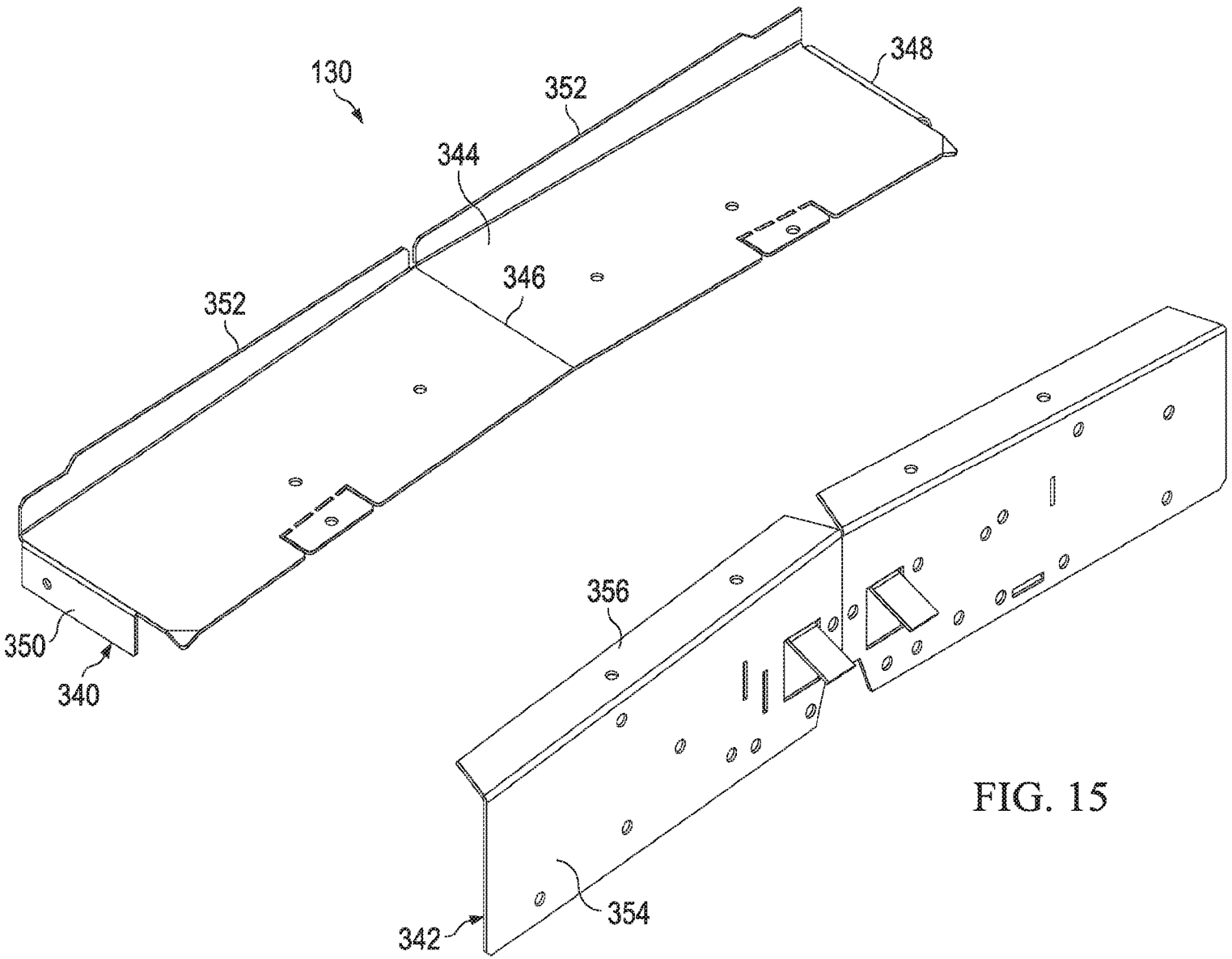
FIG. 15 is an oblique partial exploded view of the blower assembly of FIG. 2 from a rear-lower-right viewpoint.

Referring now to FIGS. 7-13, the blower assembly 130 is shown in greater detail. FIG. 7 is an oblique view of the blower assembly 130 from a front-upper-right viewpoint. FIG. 8 is an orthogonal front view of the blower assembly 130. FIG. 9 is an orthogonal rear view of the blower assembly 130. FIG. 10 is an orthogonal top view of the blower assembly 130. FIG. 11 is an orthogonal bottom view of the blower assembly 130. FIG. 12 is an orthogonal right side view of the blower assembly 130. FIG. 13 is a partial cross-sectional orthogonal right side view of the blower assembly 130. FIG. 14 is an oblique partial view of the blower assembly 130 from a rear-upper-right viewpoint. FIG. 15 is an oblique partial exploded view of the blower assembly 130 from a rear-lower-right viewpoint.

The blower assembly 130 comprises a motor 300 having a shaft upon which an impeller 304 is mounted. The motor 300 is attached to a motor mount 306 that holds the motor 300 in place relative to a left shell 308 of the blower assembly 130 and a right shell 310 of the blower assembly 130. In this embodiment, left shell 308 and the right shell 310 are selectively joined together via integral snap features as well as retaining clips 312. The snap features and the clips 312 may be operated to optionally disconnect the left shell 308 from the right shell 310. When joined, left shell 308 and the right shell 310 may be conceptualized as defining two distinct functional portions of the blower assembly 130.

One functional portion of the blower assembly 130 may be referred to as the blower housing 314. A primary function of the blower housing 314 is to receive at least a portion of each of the motor 300 and the impeller 304 while also defining an intermediate air path between each of the left air input port 316 of the blower assembly 130 and the right air input port 318 of the blower assembly 130 and the blower output 320. It is the shape of the interior of the blower housing 314 in combination with the movement of the impeller 304 that allows the optional intake of air through the right air input port 318 and the left air input port 316 and subsequent output of that air through the blower output 320. Another functional portion of the blower assembly 130 may be referred to as the blower deck 322. A first primary function of the blower deck 322 is to serve as a physical component used in mounting the entire blower assembly 130 within and relative to the blower cabinet 102. A second primary function of the blower deck 322 is to serve as a substantial air pressure barrier between the portion of the interior of the blower cabinet 102 that houses the blower assembly 130 and the interior of, in this embodiment, the heat exchanger cabinet 104.

Because the blower housing 314 and the blower deck 322 are substantially integrally formed when the left shell 308 is joined to the right shell 310, the blower housing 314 and the blower deck 322 may be conceptualized as being joined along an interface path 324. In this embodiment, interface path 324 comprises the points at which an inner surface of the blower assembly 130 begins to primarily extend at least one of a left, right, front, and/or rear direction. Accordingly, in this embodiment, the interference path 324 generally denotes a perimeter of the blower output 320.

The blower deck 322 generally comprises a left floor 326 and a right floor 328 that extend outward from the blower output 320 in a substantially left, right, front, and/or rear directions so that a generally horizontal boundary is formed. The left floor 326 extends generally horizontally outward to meet a left wall 330 of the blower deck 322, a left portion of a front wall 332 of the blower deck 322, a left portion of a rear wall 334 of the blower deck 322, and a left most portion of the right floor 328. The right floor 328 extends generally horizontally outward to meet a right wall 336 of the blower deck 322, a right portion of the front wall 332 of the blower deck 322, a right portion of the rear wall 334 of the blower deck 322, and a right most portion of the left floor 326.

In this embodiment, the left floor 326 is slightly sloped so that a left end of the left floor 326 is slightly vertically higher than a right end of the left floor 326. Similarly, in this embodiment, the right floor 328 is slightly sloped so that a right end of the right floor 326 is slightly vertically higher than a left end of the right floor 328. Further, in this embodiment, a top edge of the rear wall 334 of the left shell 308 is slightly sloped so that a right end of the top edge of the rear wall 334 of the left shell 308 is slightly vertically higher than a left end of the top edge of the rear wall 334 of the left shell 308. Similarly, in this embodiment, a top edge of the rear wall 334 of the right shell 310 is slightly sloped so that a left end of the top edge of the rear wall 334 of the right shell 310 is slightly vertically higher than a right end of the top edge of the rear wall 334 of the right shell 310. Still further, in this embodiment, a right end of the rear wall 334 of the left shell 308 is located slightly further rearward than a left end of the rear wall 334 of the left shell 308. Similarly, in this embodiment, a left end of the rear wall 334 of the right shell 310 is located slightly further rearward in a right and of the rear wall 334 of the right shell 310.

In this embodiment, structural webs 338 are provided to increase the rigidity and/or strength of the blower assembly 130. Some structural webs 338 join the left wall 330 to the left floor 326 while other structural webs 338 join the right wall 336 to the right floor 328. In this embodiment, some structural webs 338 join the left floor 326 to a left portion of the blower housing 314 while other structural webs 338 join the right floor 328 to a right portion of the blower housing 314.

Referring now additionally to FIGS. 14 and 15, a drip shield 340 and a mounting plate 342 are shown in greater detail. FIG. 14 is an oblique partial view of the blower assembly 130 from an upper-rear-right in viewpoint. FIG. 15 is an oblique partial exploded view of the blower assembly 130 from a rear-right viewpoint. FIG. 14 generally shows each of the drip shield 340 and the mounting plate 342 in their installed positions relative to the blower deck 322. FIG. 15 generally shows the drip shield 340 and the mounting plate 342 together in isolation from the remainder of the blower assembly 130 and in exploded positions relative to each other so that there is a vertical offset distance between the two.

The drip shield 340 comprises a generally horizontal cover comprising a bent plate 344 having a central ridge 346 extending in a forward-rearward direction and from such ridge 346 the bent plate 344 extends both in the left direction in the right direction. As the bent plate 344 extends from the ridge 346 in the left direction, the bent plate 344 extends slightly downward from the vertical height of the ridge 346. Similarly, as the bent plate 344 extends from the ridge 346 in the right direction, the bent plate 344 extends slightly downward from the vertical height of the ridge 346. In this embodiment, it will be appreciated that the underside of the bent plate 344 is dimensioned to complement and accordingly to optionally mate with the upper end of the front wall 332 of the blower deck 322. As shown, a rear left corner of the bent plate 344 and a rear right corner of the bent plate 344 are each locally bent vertically downward. Accordingly, when installed and/or attached to the blower deck 322, water and/or condensation that contacts the bent plate 344 from above may tend to drain downward and away from any electrical components carried by the mounting plate 342. In some embodiments, water and/or condensation may be routed by the bent plate 344 toward left floor 326 and the right floor 328 rather than pooling above any electrical components carried by the mounting plate 342.

In this embodiment, the bent plate 344 further comprises a left tab 348, a right tab 350, and front tabs 352. The left tab 348 extends generally downward from the left side of the bent plate 344. The right tab 350 extends generally downward from the right side of the bent plate 344. The front tabs 352 extend generally upward from the front side of the bent plate 344.

In this embodiment, the mounting plate 342 comprises a generally vertical component wall 354 configured for mounting against the front wall 332 of the blower deck 322. Mounting plate 342 further comprises forward tabs that extend generally forward from an upper end of the component wall 354. The upper end of the mounting plate 342 and the forward tabs 356 are configured to complement the underside of the bent plate 344 and to mate against the underside of the bent plate 344.

Referring now to FIG. 2, it can be seen that when the blower assembly 130 is installed into the blower cabinet 102, the blower deck 322 generally provides a zone boundary 358 between a first interior zone 360 of the AHU 100 and a second interior zone 362 of the AHU 100. The first interior zone 360 is generally associated with the left and right air input ports 316, 318 of the blower assembly 130 while the second interior zone 362 is generally associated with a space adjacent the blower output 320 and which, in this embodiment, is generally associated with the coil assembly 128. More specifically, in this embodiment, the left and right floors 326, 328 of the blower deck 322 generally divide the interior of the AHU 100 into the first and second interior zones 360, 362 so that operation of the motor 300 to rotate the impeller 304 may cause a pressure differential between the zones 360, 362.

In this embodiment, the blower deck 322 does not provide the entire zone boundary 358, but rather, the zone boundary 358 is at least partially defined by the drip shield 340. More specifically, in this embodiment, the zone boundary 358 comprises the left floor 326, the right floor 328, and the bent plate 344. Of course in other embodiments, the blower deck 322 may be configured to incorporate the functionality of the drip shield into the blower deck 322 itself as a unitary component. Nonetheless, this disclosure provides a blower assembly 130 that comprises components that form an entire zone boundary 358 when the blower assembly 130 is installed into the AHU 100.

More particularly, when the blower assembly 130 is installed into the AHU 100, the following components may be mated and/or located adjacent each other to produce the zone boundary 358: the rear wall 334 and the interior rear surface 156 and/or mounting channels 230, the right wall 336 and the right interior side surfaces 154 and/or mounting channels 230, the left wall 330 and the left interior side surfaces 154 and/or mounting channels 230, the upper end of the front wall 332 and the underside of the bent plate 344 of the drip shield 340, the front tabs 352 of the drip shield 340 and the back side of the blower cabinet panel 120, the left tab 348 of the drip shield 340 and the left interior side surface 154 and/or mounting channels 230, and the right tab 350 of the drip shield 340 and the right interior side surface 154 and/or mounting channels 230.

In some embodiments, a center of mass and/or a center of gravity of the blower assembly 130 is located within a periphery the components that form the zone boundary 358, as viewed from above. In some cases, by locating the center of mass and/or center of gravity in the above described manner may allow better distribution of forces due to gravity along a greater footprint so that gravitational forces do not consistently produce large bending moments against a blower deck that is not integral to a blower assembly.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. An air handling unit, comprising:

a refrigeration coil;

a drain positioned below the refrigeration coil to collect condensation from the refrigeration coil;

a blower positioned below the drain, wherein the blower comprises a blower housing with a blower deck;

a cabinet; and a drip shield separate from the drain, the drip shield positioned at least partially between the drain and the blower, wherein the drip shield is configured to route condensation away from an electrical component of the air handling unit, wherein the blower deck is slidably received within the cabinet by receiving at least a portion of the blower deck into mounting channels formed in at least two opposing interior walls of the cabinet.

2. The air handling unit of claim 1, wherein the drip shield comprises a bent plate with a central ridge, the bent plate extending vertically downward in both a left and a right direction relative to the central ridge.

3. The air handling unit of claim 2, wherein the bent plate comprises a left tab extending downward from a left side of the bent plate.

4. The air handling unit of claim 3, wherein the left tab is configured to attach to a left panel of the air handling unit.

5. The air handling unit of claim 4, wherein the bent plate comprises a right tab extending downward from a right side of the bent plate.

6. The air handling unit of claim 5, wherein the right tab is configured to attach to a right panel of the air handling unit.

7. The air handling unit of claim 6, wherein the bent plate comprises front tabs extending upward from a front side of the bent plate.

8. The air handling unit of claim 7, wherein the front tabs are configured to attach to a front panel of the air handling unit.

9. The air handling unit of claim 8, wherein the bent plate is adjacent to a mounting plate for the electronic component of the blower, and the bent plate is configured to attach to the mounting plate.

10. The air handling unit of claim 1, wherein the blower housing defines a blower outlet, wherein the blower outlet faces the drain.

11. The air handling unit of claim 10, wherein the blower deck surrounds the blower outlet.

12. The air handling unit of claim 11, wherein the blower deck is integral with the drip shield.

13. The air handling unit of claim 11, wherein the cabinet comprises an interior cavity, wherein the refrigeration coil, the drain, the drip shield, and the blower are located within the interior cavity, and wherein the blower deck physically separates the interior cavity into a first interior zone and a second interior zone to provide an air pressure barrier therebetween.

14. The air handling unit of claim 11, wherein the refrigeration coil, the drain, the drip shield, and the blower are located within the cabinet, and wherein the blower deck extends an entire distance from a left interior wall of the cabinet to an opposite right interior wall of the cabinet.

15. The air handling unit of claim 11, wherein the blower housing further comprises a first shell mated to a second shell, wherein the first shell comprises a left floor of the blower deck, and wherein the second shell comprises a right floor of the blower deck.

16. The air handling unit of claim 15, wherein the left floor is sloped so that a left end of the left floor is vertically higher than a right end of the left floor, and wherein the right floor is sloped so that a right end of the right floor is vertically higher than a left end of the right floor.

17. The air handling unit of claim 1, wherein at least some air passing through the air handling unit successively encounters at least the blower, then the drain, and then the refrigeration coil.

18. The air handling unit of claim 1, wherein the refrigeration coil is a V-shaped coil with a vertex adjacent to the drain.

19. The air handling unit of claim 1, further comprising a heater located above the refrigeration coil.

* * * * *